United States Patent [19]

Takahata et al.

[11] 4,144,184

[45] Mar. 13, 1979

[54] LIQUID DEVELOPER

[75] Inventors: Kei Takahata, Kusatsu; Sadao Murasawa, Itami; Masatsuyo Maruo, Kusatsu, all of Japan

[73] Assignee: Ishihara Sangyo Kaisha, Ltd., Osaka, Japan

[21] Appl. No.: 883,311

[22] Filed: Mar. 3, 1978

[30] Foreign Application Priority Data

Mar. 7, 1977 [JP] Japan ..... 52-23912

[51] Int. Cl.[2] ..... G03G 9/12

[52] U.S. Cl. ..... 252/62.1 L; 96/1 LY; 427/15

[58] Field of Search ..... 252/62.1 P, 62.1 L; 260/429.3; 96/1 SD, 1 LY; 427/15-17

[56] References Cited

U.S. PATENT DOCUMENTS 3,869,397 4/1975 Tellier ..... 252/62.1 L

*Primary Examiner*—John D. Welsh

*Attorney, Agent, or Firm*—Cushman, Darby & Cushman

[57] ABSTRACT

A liquid developer for subjecting an electrostatic latent image to wet development to obtain a copied image, which contains as a charge controlling agent a reaction product or mixture of zirconium (tetravalent) alkoxide or vanadyl (trivalent) alkoxide and an organic compound containing hydroxyl group, carboxyl group or carbon-carbon double bond in its molecule can reproduce an original clearly and exactly.

10 Claims, 1 Drawing Figure

LIQUID DEVELOPER

Figure 1:
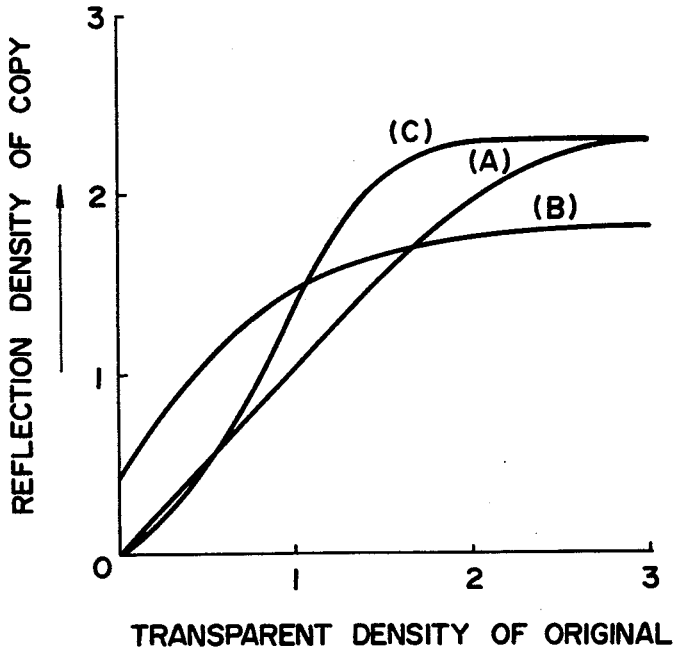

The present invention relates to a liquid developer used in electrophotography wherein a photographic print is obtained by subjecting an electrostatic latent image to wet development. More particularly, the invention pertains to a liquid developer containing as a charge controlling agent a reaction product or mixture of a zirconium (tetravalent) alkoxide or vanadyl (trivalent) alkoxide and an organic compound containing hydroxyl group, carboxyl group or carbon-carbon double bond.

There has heretofore been used a liquid developer for an electrostatic latent image produced by dispersing a particulate coloring agent in a liquid of sufficiently high electrical resistivity such as a liquid hydrocarbon. The developer has generally been used in combination with a dispersing agent, a stabilizing agent and a charge controlling agent in order to improve the dispersibility of the particulate coloring agent and control the charge. Regarding the charge controlling agent, there are proposed in, for example, Japanese Patent Kokoku (Post-Exam. Publn.) Nos. 18,117/71 and 6,157/71 and Japanese Patent Kokai (Laid-Open) Nos. 122,340/74, 151,154/75 and 6,559/76, a process which comprises using a salt of naphthenic acid, stearic acid and oleic acid with a Group IV-VIII metal such as Mn, Ni, Co or Zr, a process which comprises using a reaction product of an alkyd resin or a resin composition consisting of an alkyd resin containing a small amount of another synthetic resin having a double bond, carboxyl group or hydroxyl group with a tetravalent organic titanium compound, a process which comprises using a reaction product of a fatty acid such as caproic acid, capric acid or lauric acid with a tetravalent organic titanium compound, and a process which comprises using a reaction product of an acrylic resin or a resin composition consisting of an acrylic resin containing a small amount of another synthetic resin having a double bond, carboxyl group or hydroxyl group with a trivalent organic aluminum compound or a tetravalent organic titanium compound.

When an electrostatic latent image is developed with a liquid developer, it is required for the developer (1) to form no fog, (2) to be able to reproduce a continuous tone, (3) to be able to increase an image density, and (4) to achieve rapid development. In color development, these properties are particularly required.

As a result of extensive studies, the present inventors have found liquid developers having the above-mentioned properties which are superior to the liquid developers as proposed above. The present invention has been completed based on this finding.

An object of the present invention is to provide a liquid developer which has the above-mentioned properties and can reproduce an original clearly and exactly.

According to the present invention, there is provided a liquid developer for an electrostatic latent image comprising a liquid of sufficiently high electrical resistivity, a particulate coloring agent and a charge controlling agent wherein said charge controlling agent is a mixture or reaction product of a zirconium (tetravalent) alkoxide or a vanadyl (trivalent) alkoxide with an organic compound containing hydroxyl group, carboxyl group or a carbon-carbon double bond in its molecule.

The accompanying FIGURE shows a relationship between the transparent density of original and the reflection density of copy in a liquid developer according to the present invention and two prior art liquid developers.

Specific examples of the zirconium (tetravalent) alkoxide used in the present invention include zirconium tetra-n-butoxide, zirconium tetra-iso-butoxide, zirconium tetrastearoxide, zirconium tetra-n-propoxide, zirconium tetramethoxide, monochlorozirconium tri-iso-propoxide and dimer and trimer thereof, but tetraalkoxides are favorable to use. Also, specific examples of vanadyl (trivalent) alkoxide include vanadyl tri-n-butoxide, vanadyl tri-iso-butoxide, vanadyl tristearoxide, vanadyl trimethoxide, monochlorovanadyl di-n-propoxide and monochlorovanadyl di-iso-propoxide, but trialkoxides are favorable to use.

The organic compounds to be mixed or reacted with the above-mentioned zirconium alkoxides or vanadyl alkoxides are those containing hydroxyl group, carboxyl group or a carbon-carbon double bond in their molecule. Among them are particularly desirable resins and carboxylic acids from a viewpoint of ability to give charge and durability to the resulting developer. As such resins, for example, alkyd resins, acrylic resins, petroleum resins, hydrocarbon resins, silicone resins, rubbers, phenol resins, natural resins and processed products thereof may be used. Among them are particularly desirable alkyd resins, acrylic resins, petroleum resins and rubbers from a viewpoint of ability to give charge and durability to the resulting developer. As the carboxylic acids, saturated or unsaturated carboxylic acids having 6 to 20, and preferably 8 to 18, carbon atoms in their molecule are preferable. Specific preferable examples thereof include lauric acid, myristic acid, palmitic acid, linolic acid, stearic acid, stearic anhydride, oleic acid, naphthenic acid, octenoic acid, octylic acid, sebacic acid, cyclohexanecarboxylic acid, undecanoic acid, linolenic acid, cyclohexanedicarboxylic acid, cyclohexanepropionic acid, n-capric acid, α-ethyl-α-phenylacetic acid, and fatty acids obtained by processing animal and vegetable oils. As the resins, any resin within the range of the above-mentioned resins may be used without restriction. For example, the above-mentioned resins modified with soybean oil, linseed oil, tung oil or castor oil, the above-mentioned resins containing a small amount of the other synthetic resins or the above-mentioned resins containing monomer which are copolymerizable with the above-mentioned resins may be used. Also, among said carboxylic acids, lauric acid, myristic acid, palmitic acid, linolic acid, stearic acid, stearic anhydride, oleic acid, naphthenic acid, octenoic acid, octylic acid, undecanoic acid and linolenic acid are particularly preferable from a viewpoint of charge controlling ability and the durability of the resulting developer.

In the present invention, the above-mentioned zirconium alkoxide or vanadyl alkoxide is reacted or mixed with one or more of the above-mentioned organic compounds. The resulting reaction product or mixture is dispersed or dissolved in a liquid of sufficiently high electrical resistivity. For example, the reaction is carried out by heating the reactants in an inert solvent and in an atmosphere of an inert gas such as nitrogen gas at a temperature of 80° to 200° C., and preferably 100° to 180° C., for 1 to 10 hours, and preferably 2 to 5 hours. The reaction product is usually colored although the degree of coloring varies. This coloring has less influence upon the visible wavelength region since its light absorption region is deflected to the shorter wavelength side as compared with the case of titanium alkoxides, and gives a preferable result for the object of the use of a color developer. In the case of mixing, for example, the above-mentioned zirconium alkoxide or vanadyl alkoxide is dissolved in a solvent, and the resulting solution is then mixed with the organic compound. Even when merely mixed, a similar coloring, that is, similar light absorption occurs in the visible wavelength region or ultraviolet region although the degree of coloring is lower than when reacted. It is presumed that a certain kind of coordination has occurred in this case. A ratio of the zirconium alkoxide or vanadyl alkoxide to the organic compound to be mixed or reacted with each other depends upon the kind of the organic compound. For example, in a combination of a zirconium alkoxide and a carboxylic acid having 6 to 20 carbon atoms, the ratio is 1 to 0.25 mole, and preferably 0.33 to 0.25 mole, of the zirconium alkoxide per mole of carboxyl group contained in the carboxylic acid. Also, in a combination of a zirconium alkoxide and a resin such as an alkyd resin, acrylic resin or petroleum resin or a rubber, the ratio is 1 to 0.001 mole, and preferably 0.25 to 0.01 mole, of the zirconium alkoxide per mole of the functional group (carboxyl group, hydroxyl group or carbon-carbon double bond) contained in the resin or rubber. In a combination of a vanadyl alkoxide and a carboxylic acid having 6 to 20 carbon atoms, the ratio is 1 to 0.33 mole, and preferably 0.67 to 0.33 mole, of the vanadyl alkoxide per mole of carboxyl group contained in the carboxylic acid. Further, in a combination of a vanadyl alkoxide and a resin such as an alkyd resin, acrylic resin or petroleum resin or a rubber, the ratio is 1 to 0.001 mole, and preferably 0.33 to 0.01 mole, of the vanadyl alkoxide per mole of the functional group contained in the resin or rubber.

The said zirconium alkoxide or vanadyl alkoxide reacts as a polyfunctional compound while the organic compound reacted therewith is also a polyfunctional compound. If the amount of the zirconium alkoxide or vanadyl alkoxide reacted exceeds the preferable range, therefore, gellation often occurs. The gellation can be prevented by selecting the solvent and reaction conditions used suitably, but it is also effective to use a monofunctional organic compound in combination with the alkoxides. For example, it is one of useful means for preventing gellation to react the monofunctional organic compound previously with part of the functional group of the zirconium alkoxide or vanadyl alkoxide.

The concentration of the mixture or reaction product thus obtained in a liquid of sufficiently high electrical resistivity is suitably 0.02 to 2% by weight, and preferably 0.05 to 1% by weight. It is also possible to use various combinations of the mixtures or reaction products within this concentration range.

The mixture or reaction product of the zirconium (tetravalent) alkoxide or vanadyl (trivalent) alkoxide with the organic compound is excellent in charge controlling ability and can make an image clear. Particularly, when a zirconium alkoxide is used, they are remarkably effective in controlling the positive charge of toner particles. Also, when a vanadyl alkoxide is used, they are remakably effective in controlling the negative charge of toner particles. In electrophotography, positively charged or negatively charged toner particles can be effectively used for both positively charged and negatively charged electrostatic latent images by selecting either positive-positive system or negative-positive system as a development system. Also, when the vanadyl (trivalent) alkoxide is used, they are characterized by decreasing the amount of leak current or development and improving development efficiency. It is well known that metal salts, for example, Zn salts of organic acids are useful as a charge controlling agent, but the charge controlling agents used in the present invention are advantages over such prior art agents in that their development velocity is higher, no fog occurs, the density of the image formed is higher, and an image of a precise and continuous tone can be obtained.

As the liquid of sufficiently high electrical resistivity used in the present invention, a wide range of dispersion media used generally such as liquid n-paraffinic hydrocarbons, iso-paraffinic hydrocarbons, halogenated hydrocarbons, xylene, toluene and carbon tetrachloride may be used, but iso-paraffinic hydrocarbons having a comparatively small dissolving power are preferable in that they do not dissolve forcign substances.

Also, as the particulate coloring agent used in the present invention, many organic or inorganic pigments used generally may be used. For example, white pigments such as titanium oxide and zinc oxide, black pigments such as carbon black and aniline black, and colored pigments such as chrome yellow, cadmium yellow, Hansa Yellow, Chrome Orange, quinacridone, Methyl Violet lake, ultramarine blue, cobalt blue, Phthalocyanine Blue, chrome green and Malachite Green lake may be used. Such particulate coloring agents are used in an amount of 0.05 to 10 g, and preferably 0.1 to 5 g, per liter of the liquid of sufficiently high electrical resistivity.

In the present invention, resins generally used as a stabilizing agent for a developer such as an alkyd resin, acrylic resin and petroleum resin may be added. When a reaction product or mixture of a zirconium alkoxide or vanadyl alkoxide with a carboxylic acid is used as a charge controlling agent, it is desirable to add the above-mentioned stabilizing agent. On the other hand, when a reaction product or mixture of the alkoxide with a resin is used as a charge controlling agent, it is not necessarily required to add such a stabilizing agent.

The following examples illustrate the present invention in more detail.

EXAMPLE 1

Into a 200 cc four-neck flask equipped with a stirrer, an inlet for nitrogen gas, a condenser and a thermometer were charged 60 g of naphthenic acid, 25 g of a 90% by weight solution of zirconium tetra-n-butoxide in iso-propyl alcohol and 30 cc of Isopar G (a high purity iso-paraffinic hydrocarbon solvent manufactured by Esso Kagaku K.K.). The contents of the flask were reacted at 130° C. for 2 hours and then at 170° C. for 10 minutes while nitrogen gas was blown into the flask. The reaction product thus obtained was diluted with Isopar G so that its Zr content might be 10 g/l. Into a glass bottle was charged 2.5 cc of the diluted product. The following compounds and glass beads as a milling medium were added thereto:

| | |
|---|---|
| Heliogen Blue 7100 | 0.5 g |
| Isopar G | 9.9 cc |
| Kanelube 1152S (an acrylic resin manufactured by Kanebo Ltd.) as a 25% by weight Isoper G solution (as a stabilizing agent) | 7.2 cc |

The charged materials were milled by a paint shaker (manufactured by Red Devil Co.) for about 15 minutes to prepare a concentrate.

A liquid developer for electrophotography was obtained by diluting 1 cc of the thus obtained concentrate with Isopar G to a volume of 100 cc. When an electrostatic latent image on a copying paper was formed with an electrophotographic copying machine and then developed with this liquid developer, a clear copied image was obtained.

Further, a copying paper containing $TiO_2$ as a photosensitive material was exposed to light through a photographic step tablet No. 2 (manufactured by Eastman Kodak Co.) placed thereon and in contact therewith, and was then developed with said liquid developer. A transparent protective film was formed on the thus obtained pattern with Air Sol Lacquer Airon (clear lacquer, manufactured by Kansai Paint Co., Ltd.). The reflection density of copy at each transparent density of original was measured by a Photoelectric Densito-Meter (COL-T & R, manufactured by Nalumi Co., Ltd.). With regard to a relationship between the transparent density of original and the reflection density of copy, a curve (A) in the accompanying drawing was obtained.

Comparative Example 1

A commercially available zirconium naphthenate solution (8% by weight as Zr) in place of the reaction product of Example 1 was diluted with Isopar G so that its Zr content might be 10 g/l. A liquid developer was obtained from 2.5 cc of the thus obtained diluted product in the same manner as in Example 1. Further, the reflection density of copy at each transparent density of original in the use of this liquid developer was measured in the same manner as in Example 1. With regard to a relationship between the transparent density of original and the reflection density of a copy, a curve (B) in the accompanying drawing was obtained.

As is clear from a comparison between the curves (A) and (B) in the accompanying drawing, the reflection density of copy in the curve (B) does not reach 0 when the transparent density of original is 0. It shows that fog occurred in the case of the developer of Comparative Example 1. On the other hand, the reflection density of copy in the curve (A) reaches 0 when the transparent density of original is 0. It shows that no fog occurred in the case of the developer of Example 1. Also, since the reflection density of copy can be reproduced to a higher region in the curve (A), it is seen that an image of a higher density can be obtained.

Comparative Example 2

Titanium tetra-n-butoxide in place of zirconium tetra-n-butoxide in Example 1 was reacted with naphthenic acid in the same manner as in Example 1. The resulting reaction product was diluted so that its Ti content might be the same molar concentration as the Zr content of the reaction product in Example 1. A liquid developer was produced by subjecting 2.5 cc of the diluted reaction product to the same treatment as in Example 1.

The reaction product obtained in this comparative example was remarkably colored in contrast with the reaction product in the present invention and was not preferable as a charge controlling agent. Also, the reaction product of this comparative example was inferior to the reaction product of the present invention in ability to give charge. Further, the reflection density of copy at each transparent density of original was measured in the same manner as in Example 1. With regard to a relationship between the transparent density of original and the reflection density of copy, a curve (C) in the accompanying drawing was obtained. The curve (C) is greater in slope than the curve (A). It shows that only an image which has narrow continuous tone region and which has a large edge effect can be obtained with the developer of Comprative Example 2 and the developer is not preferable as a developer for color image.

EXAMPLE 2

Into a glass bottle were charged 0.5 g of Lionogen Magneta R (manufactured by Toyo Ink Manufacturing Co., Ltd., quinacridone) as a particulate coloring agent, 13 cc of a solution of linolic acid in xylene (100 g/l), 6 cc of a solution (10 g/l as Zr) of zirconium tetra-n-propoxide in Isopar H (an iso-paraffinic hydrocarbon, manufactured by Esso Kagaku K.K.), 3.0 g of a 50% by weight solution of Plexol 966 (acrylic resin, manufactured by Rohm & Haas Co.) in xylene and 4 cc of xylene. Glass beads as a milling medium were added thereto and the contents of the flask were milled by a paint shaker for about 30 minutes to prepare a concentrate.

Concentrates were prepared in the same manner as described above except that linolic acid was replaced by myristic acid, stearic acid, stearic anhydride, oleic acid, lauric acid, sebacic acid, cyclohexanecarboxylic acid, cis-1,2-cyclohexanedicarboxylic acid, cyclohexanepropionic acid, n-capric acid or α-ethyl-α-phenylacetic acid.

Liquid developers were obtained by diluting 1 cc each of these concentrates with Isopar H to a volume of 100 cc. When an electrostatic latent image on a copying paper was formed with an electrophotographic copying machine and was then developed with these liquid developers, a clear copied image was obtained in all cases. Further, the reflection density of copy at each transparent density of original in the use of the respective liquid developers was measured in the same manner as in Example 1. A curve showing a relationship between the transparent density of original and the reflection density of copy in all of the developers was almost similar to that in Example 1.

Liquid developers were prepared in the same manner as in Example 2 except that the solution of zirconium tetra-n-propoxide in Isopar H was not added, but development with these liquid developers did substantially not give a copied image.

EXAMPLE 3

Into a 200 cc four-neck flask equipped with a stirrer, an inlet for nitrogen gas, a condenser and a thermometer were charged 28.3 g of oleic acid, 25 cc of a solution of zirconium tetra-n-butoxide in Isopar H (91.2 g/l as Zr) and 50 cc of Isopar H. The contents of the flask were reacted at 120° C. for 2 hours and then at 140° C. for 1 hour while nitrogen gas was blown into the flask. The thus obtained reaction product was diluted with Isopar H to a weight of 125 g. Into a glass bottle was charged 2.7 cc of the diluted reaction product. The following compounds and glass beads as a milling medium were added thereto:

| | |
|---|---|
| Lionogen Magenta R | 0.5 g |
| Xylene | 13.3 cc |
| A 50% by weight solution of Plexol 966 in xylene (as a | |

-continued

| | |
|---|---|
| stabilizing agent) | 3.6 cc |

The charged materials were milled by a paint shaker for about 15 minutes to prepare a concentrate.

A liquid developer for electrophotography was obtained by diluting 1 cc of the thus obtained concentrate with Isopar H to a volume of 50 cc. When an electrostatic latent image on a copying paper was formed with an electrophotographic copying machine and was then developed with this liquid developer, the same clear copied image was obtained as in Example 1. A curve showing a relationship between the transparent density of original and the reflection density of copy was also almost similar to that in Example 1.

EXAMPLE 4

A liquid developer was prepared in the same manner as in Example 3 except that 20 g of lauric acid was used in place of 28.3 g of oleic acid.

When an electrostatic latent image on a copying paper was formed with an electrophotographic copying machine and was then developed with this liquid developer, the same clear copied image was obtained as in Example 1. A curve showing a relationship between the transparent density of original and the reflection density of copy was also almost similar to that in Example 1.

EXAMPLE 5

A liquid developer was prepared in the same manner as in Example 3 except that 28.3 g of oleic acid was replaced by 28 g of linolic acid and 25 cc of a solution of zirconium tetra-n-butoxide in Isopar H was replaced by 100 cc of a solution of zirconium tetraethoxide in xylene (91.2 g/l as Zr).

When an electrostatic latent image on a copying paper was formed with an electrophotographic copying machine and was then developed with this liquid developer, the same clear copied image was obtained as in Example 1. A curve showing a relationship between the transparent density of original and the reflection density of copy was also almost similar to that in Example 1.

EXAMPLE 6

A liquid developer was prepared in the same manner as in Example 3 except that 28.3 g of oleic acid was replaced by 28.4 g of stearic acid and 25 cc of a solution of zirconium tetra-n-butoxide in Isopar H was replaced by 33 cc of a solution of zirconium tetramethoxide in xylene (91.2 g/l as Zr).

When an electrostatic latent image on a copying paper was formed with an electrophotographic copying machine and was then developed with this liquid developer, the same clear copied image was obtained as in Example 1. A curve showing a relationship between the transparent density of original and the relfection density of copy was also almost similar to that in Example 1.

EXAMPLE 7

Into a glass bottle were charged 0.5 g of Lionogen Magenta R as a particulate coloring agent, 6 g of a 25% by weight solution of different resins as described below in xylene, 3 cc of a solution of zirconium tetra-n-butoxide in Isopar H (20 g/l as Zr), 1.2 cc of a 50% by weight solution of Plexol 966 in Isopar H, 6 cc of xylene and 3.4 cc of Isopar H. Glass beads as a milling medium were added thereto and the charged materials were milled by a paint shaker for about 30 minutes to prepare different concentrates.

| | Resin | | |
|---|---|---|---|
| No. | Trademark | Main Component | Manufacturer |
| 1 | Thermolite N | Cyclized rubber | Seiko Chemical Co., Ltd. |
| 2 | Thermolite P | Cyclized rubber | " |
| 3 | #5001 | Linseed oil-modified alkyd resin | Arakawa Chemical Ind. Ltd. |
| 4 | Super Beckacite 1001 | Phenol resin | Japan Reichhold Chemicals, Inc. |
| 5 | Tamanol 135 | Rosin-modified phenol resin | Arakawa Chemical Ind. Ltd. |
| 6 | Estergum A | Rosin ester | " |
| 7 | Staybelite Resin | Hydrogenated rosin | " |
| 8 | Yatall MA | Tall oil | Yasuhara Yusi Kogyo Co., Ltd. |
| 9 | Tallrosin | Tall oil rosin | Arakawa Chemical Ind. Ltd. |
| 10 | KR-5208 | Silicone-acrylic resin | Shin-etsu Chemical Ind. Co., Ltd. |
| 11 | IR-2200 | Isoprene rubber | Nippon Geon Co., Ltd. |
| 12 | Neopolymer 140 | Petroleum resin | Nippon Petrochemicals Co., Ltd. |
| 13 | Escorez 103U | Petroleum resin | Esso Kagaku K.K. |
| 14 | SK-1000 | Hydrocarbon resin | Tonen Sekiyu-kagaku K.K. |
| 15 | Paraloid B-67 | Acrylic resin | Rohm & Haas Company |
| 16 | Paraloid B-72 | Acrylic resin | " |

Liquid developers were prepared by diluting 1 cc each of the concentrates Nos. 1–11 with Isopar H to a volume of 100 cc or by diluting 1 cc each of the concentrates Nos. 12–16 with a 1:1 (by weight) mixed solvent of xylene and Isopar H to a volume of 100 cc.

When an electrostatic latent image on a copying paper was formed with an electrophotographic copying machine and was then developed with these liquid developers, the same clear copied image was obtained as in Example 1. A curve showing a relationship between the transparent density of original and the reflection density of copy was also almost similar to that in Example 1.

EXAMPLE 8

Into a 200 cc four-neck flask equipped with a stirrer, an inlet for nitrogen gas, a condenser and a thermometer were charged 100 g of a 50% by weight solution of Beckosol EL-8011 (a linseed oil-modified alkyd resin, acid value 6 or less, manufactured by Dai Nippon Ink & Chemicals Inc.) in Isopar H and 4.5 cc of a solution of zirconium tetra-n-butoxide in Isopar H (91.2 g/l as Zr). The contents of the flask were reacted at 140° C. for 2 hours while nitrogen gas was blown into the flask. The thus obtained reaction product was diluted with Isopar H to a weight of 125 g. Into a glass bottle was charged 3 cc of the diluted reaction product. The following compounds and glass beads as a milling medium were added thereto and the charged materials were milled by a paint shaker for about 15 minutes to prepare a concentrate:

| | |
|---|---|
| Lionogen Magenta R | 0.5 g |
| Xylene | 5 cc |
| Isopar H | 11.6 cc |

A liquid developer for electrophotography was obtained by diluting 1 cc of the thus obtained concentrate with Isopar H to a volume of 100 cc.

When an electrostatic latent image on a copying paper was formed with an electrophotographic copying machine and was then developed with this liquid developer, the same clear copied image was obtained as in Example 1. A curve showing a relationship between the transparent density of original and the reflection density of copy was also almost similar to that in Example 1.

EXAMPLE 9

Into the same four-neck flask as that used in Example 3 were charged 78.8 g of a 40% by weight solution of Escorez 1071U (a petroleum resin, acid value 1 or less, manufactured by Esso Kagaku K.K.) in Isopar H and 9.1 cc of a solution of zirconium tetra-iso-propoxide in Isopar H (100 g/l as Zr). The contents of the flask were reacted at 120° C. for 1 hour, at 140° C. for 1 hour, and then at 150° C. for 30 minutes while nitrogen gas was blown into the flask. The thus obtained reaction product was diluted with Isopar H to a weight of 126 g. Into a glass bottle was charged 5 cc of the diluted reaction product. The following compounds and glass beads as a milling medium were added thereto and the charged materials were milled by a paint shaker for about 15 minutes to prepare a concentrate:

| | |
|---|---|
| Lionogen Magenta R | 0.5 g |
| Xylene | 5 cc |
| Isopar H | 11.6 cc |

A liquid developer for electrophotography was prepared by diluting 1 cc of the thus obtained concentrate with Isopar H to a volume of 100 cc.

When an electrostatic latent image on a copying paper was formed with an electrophotographic copying machine and was then developed with this liquid developer, the same clear copied image was obtained as in Example 1. A curve showing a relationship between the transparent density of original and the reflection density of copy was also almost similar to that in Example 1.

EXAMPLE 10

Into the same four-neck flask as that used in Example 3 were charged 100 g of a 50% by weight solution of Paraloid B-67 (an acrylic resin manufactured by Rhom & Haas Company) in Isopar H, 4 cc of a solution of zirconium tetra-n-butoxide in Isopar H (100 g/l as Zr) and 20 g of xylene. The contents of the flask were reacted at 120° C. for 2 hours, at 150° C. for 2 hours and then at 160° C. for 1 hour while nitrogen gas was blown into the flask. The thus obtained reaction product was diluted with a 3:1 (by weight) mixed solvent of Isopar H and xylene to a weight of 167 g. Into a glass bottle was charged 4 cc of the diluted reaction product. The following compounds and glass beads as a milling medium were added thereto and the charged materials were milled by a paint shaker for about 15 minutes to prepare a concentrate:

| | |
|---|---|
| Lionogen Magenta R | 0.5 g |
| Xylene | 5 cc |
| Isopar H | 10.6 cc |

A liquid developer for electrophotography was prepared by diluting 1 cc of the thus obtained concentrate with a 1:1 (by weight) mixed solvent of xylene and Isopar H to a volume of 100 cc.

When an electrostatic latent image on a copying paper was formed with an electrophotographic copying machine and was then developed with this liquid developer, the same clear copied image was obtained as in Example 1. A curve showing a relationship between the transparent density of original and the reflection density of copy was also almost similar to that in Example 1.

EXAMPLE 11

Into a glass bottle were charged 1.5 cc of a 50% by weight solution of Yatall MA (a mixture of tall oil fatty acids and tall oil resin acids, acid value 145 or more, manufactured by Yasuhara Yusi Kogyo Co., Ltd.) in xylene, 0.5 g of Lionogen Magenta R, 6 cc of a solution of vanadyl tri-n-butoxide in Isopar H (10 g/l as V), 1.2 cc of a 50% by weight solution of Plexol 966 (as a stabilizing agent) in Isopar H, 8 cc of xylene and 2.9 cc of Isopar H. The contents of the glass bottle were then treated in the same manner as in Example 2 to obtain a liquid developer.

When two glass electrode plates were dipped in this liquid developer and a voltage was applied, the developer was deposited on the anode plate. Thus, it was found that the developer had been negatively charged. Also, a leak current was very small in this case and it was found that the developer was capable of developing efficiently.

A curve showing a relationship between the transparent density of original and the reflection density of copy was almost similar to that in Example 1.

EXAMPLE 12

Into the same four-neck flask as that used in Example 3 were charged 2.68 g of lauric acid, 4 cc of a solution of zirconium tetra-n-butoxide in Isopar H (100 g/l as Zr) and 30 cc of Isopar H. The contents of the flask were reacted at 120° C. for 1 hour while nitrogen gas was blown into the flask. Thereto was added 100 g of a 50% by weight solution of Beckosol EL-8011 in Isopar H. The resulting mixture was reacted at 140° C. for 1 hour while nitrogen gas was blown thereinto. The reaction product was diluted with Isopar H to a weight of 150 g. Into a glass bottle was charged 3.6 cc of the diluted reaction product. The following compounds and glass beads as a milling medium were added thereto and the charged materials were milled by a paint shaker for about 15 minutes to prepare a concentrate:

| | |
|---|---|
| Lionogen Magenta R | 0.5 g |
| Xylene | 5 cc |
| Isopar H | 11 cc |

The thus obtained concentrate was diluted in the same manner as in Example 3 to obtain a liquid developer.

When an electrostatic latent image on a copying paper was formed with an electrophotographic copying machine and was then developed with this liquid developer, the same clear copied image was obtained as in Example 1. A curve showing a relationship between the transparent density of original and the reflection density of copy was also almost similar to that in Example 1.

EXAMPLE 13

A liquid developer was prepared in the same manner as in Example 12 except that 2.68 g of lauric acid was replaced by 3.68 g of oleic acid.

When an electrostatic latent image on a copying paper was formed with an electrophotographic copying machine and was then developed with this liquid developer, the same clear copied image was obtained as in Example 1. A curve showing a relationship between the transparent density or original and the reflection density of copy was also almost similar to that in Example 1.

What is claimed is:

1. A liquid developer for an electrostatic latent image comprising a liquid of sufficiently high electrical resistivity, a particulate coloring agent and a charge controlling agent wherein said charge controlling agent is a mixture or reaction product of a zirconium (tetravalent) alkoxide or a vanadyl (trivalent) alkoxide with an organic compound containing hydroxyl group, carboxyl group or a carbon-carbon double bond in its molecule.

2. A liquid developer according to claim 1, wherein said charge controlling agent is obtained by heating a zirconium (tetravalent) alkoxide or a vanadyl (trivalent) alkoxide and an organic compound containing hydroxyl group, carboxyl group or a carbon-carbon double bond in its molecule at a temperature of 80° to 200° C. for 1 to 10 hours.

3. A liquid developer according to claim 1, wherein said zirconium (tetravalent) alkoxide is a zirconium tetraalkoxide.

4. A liquid developer according to claim 1, wherein said vanadyl (trivalent) alkoxide is a vanadyl trialkoxide.

5. A liquid developer according to claim 1, wherein said organic compound containing hydroxyl group, carboxyl group or a carbon-carbon double bond in its molecule is a saturated or unsaturated carboxylic acid having 6 to 20 carbon atoms.

6. A liquid developer according to claim 1, wherein said organic compound containing hydroxyl group, carboxyl group or a carbon-carbon double bond in its molecule is at least one member selected from the group consisting of alkyd resins, acrylic resins, petroleum resins and rubbers.

7. A liquid developer according to claim 1, wherein said organic compound containing hydroxyl group, carboxyl group or a carbon-carbon double bond in its molecule is a carboxylic acid selected from the group consisting of myristic acid, stearic acid, stearic anhydride, oleic acid, linolic acid, lauric acid, palmitic acid, naphthenic acid, octenoic acid, octylic acid, undecanoic acid and linolenic acid.

8. A liquid developer for an electrostatic latent image comprising a liquid of sufficiently high electrical resistivity, a particulate coloring agent and a charge controlling agent, wherein said charge controlling agent is a reaction product of a zirconium (tetravalent) alkoxide with a saturated or unsaturated carboxylic acid having 8 to 18 carbon atoms.

9. A liquid developer according to claim 8, wherein said charge controlling agent is obtained by heating a zirconium (tetravalent) alkoxide and a saturated or unsaturated carboxylic acid having 8 to 18 carbon atoms at a temperature of 80° to 200° C. for 1 to 10 hours.

10. A liquid developer according to claim 8, wherein said charge controlling agent is obtained by reacting 1 to 0.25 mole of a zirconium (tetravalent) alkoxide with 1 mole of carboxyl group contained in a saturated or unsaturated carboxylic acid having 8 to 18 carbon atoms.

* * * * *